United States Patent [19]

Nelson

[11] Patent Number: 5,062,630

[45] Date of Patent: Nov. 5, 1991

[54] GYMNASTIC TRAINING DEVICE

[75] Inventor: Riley H. Nelson, Oshawa, Canada

[73] Assignee: 859545 Ontario Ltd., Bowmanville, Canada

[21] Appl. No.: 488,563

[22] Filed: Mar. 6, 1990

[30] Foreign Application Priority Data

Aug. 21, 1989 [CA] Canada ..... 608851

[51] Int. Cl.[5] ..... A63B 22/20

[52] U.S. Cl. ..... 272/111; 272/33 R; 272/114; 272/146; 272/DIG. 93; 280/87.042

[58] Field of Search ..... 272/28, 30, 31 A, 31 R, 272/33 R, 70, 93, 111, 126, 127, 129, 130, 134, 146, 114; 280/87.041, 87.042, 87.043

[56] References Cited

U.S. PATENT DOCUMENTS

| | | | |
|---|---|---|---|
| 3,604,726 | 9/1971 | Tracy | 272/146 X |
| 3,630,540 | 12/1971 | Smith | 272/146 X |
| 4,601,469 | 7/1986 | Sasser, Jr. | 272/111 X |
| 4,673,180 | 6/1987 | Rice | 272/146 |
| 4,886,298 | 12/1989 | Shols | 280/87.042 X |
| 4,887,824 | 12/1989 | Zatlin | 280/87.042 |
| 4,948,124 | 8/1990 | Ghaly | 272/146 X |

FOREIGN PATENT DOCUMENTS

| | | | |
|---|---|---|---|
| 2235884 | 3/1974 | Fed. Rep. of Germany | 272/146 |
| 1419408 | 10/1965 | France | 272/111 |

*Primary Examiner*—Robert Bahr

*Attorney, Agent, or Firm*—Rogers, Bereskin & Parr

[57] ABSTRACT

A gymnastic training device has a first substantially horizontal support and a substantially vertical support member, the upper end of the substantially vertical support member is rotatably mounted on the lower side of the first substantially horizontal support. A ground engaging wheel is mounted to the lower end of the substantially vertical support member. The gymnastic training device also has a second substantially horizontal support which is fixedly mounted on the substantially vertical support member between the ground engaging wheel and the first substantially horizontal support.

24 Claims, 4 Drawing Sheets

GYMNASTIC TRAINING DEVICE

FIELD OF THE INVENTION

This invention relates to a gymnastic training device which may be used to develop upper body muscles and to teach the user co-ordination and balance when they are upside down. More particularly, this invention relates to a gymnastic training device that allows the user to develop the skills and strength needed to perform handstands and other acrobatic manoeuvres.

BACKGROUND OF THE INVENTION

Recreational devices such as unicycles, bicycles and skateboards are intended for operation with the user either seated or standing in an upright position. These devices result in the user developing co-ordination and strength for the lower body while the user is in an upright position. A disadvantage of such devices is that they do not provide the user with the means to develop balance, co-ordination and strength in the upper body while the user is upside down.

Training devices such as the parallel bars or the rings are intended for operation while the user is at times upside down. A disadvantage of these devices is that they are not easily portable. Further, such devices are either in a fixed position when they are in use (such as the parallel bars) or the device is only permitted a limited amount of movement when in use (such as the rings). Thus, another disadvantage of these devices is that they are not freely mobile when they are in use and thus do not permit the user the opportunity to develop balance co-ordination and strength in the upper body while the user is upside down and mobile. A further disadvantage of such devices is that they are not easily moved from one location to another.

BRIEF SUMMARY OF THE INVENTION

It has been found that these problems can be overcome by using a gymnastic training device that comprises a first support means which defines an upper side and a lower side, the lower side of said first support means having a central portion. The device also includes a support member having first and second ends. The first support means is mounted on one end of the support member within the central portion of the lower side of the first support means. Means for permitting rotation of the first support means about the support member in a plane which is substantially horizontal is provided. Ground engaging wheel means is mounted to the other end of the first support member.

In another embodiment, the gymnastic training device also includes a second support means which is generally horizontal in orientation. The second support means is fixedly attached to the support member at a location on the support member between the ground engaging wheel means and the first support means. Optionally, the device may also include one or more, and preferably, three rotatably mounted wheel means which are attached to the lower side of the second support means. The rotatably mounted wheel means are mounted such that the lowermost portion of the ground engaging wheel means is lower than the lowermost portion of each of the rotatably mounted wheel means when the plane defined by the rotatably mounted wheel means is horizontal.

The invention also relates to a gymnastic training device comprised of a first support means defining an upper side and a lower side. The lower side has a central portion. The device also comprises a first support member having first and second ends. The first support means is mounted on one end of the first support member within the central portion of the lower side of the first support means. Ground engaging wheel means is mounted to the other end of the first support member. Three rotatably mounted wheel means are also provided. The wheel means are mounted on the lower side of the first support means and define a triangle which encompasses therein the ground engaging wheel means. The lowermost portion of the ground engaging wheel means is lower than the lowermost portion of each of the ground engaging wheel means when the plane defined by the rotatably mounted wheel means is horizontal.

The ground engaging wheel means provides a point upon which the user may balance when using the device. To aid a novice, three rotatably mounted wheel means are provided which act as training wheels. The user thus has a relatively stable balancing surface which is freely movable relative to the ground while in operation.

BRIEF DESCRIPTION OF THE DRAWINGS

The substance and advantages of the invention may be more completely and fully understood by means of the following description of the accompanying drawings of a preferred embodiment of the gymnastic training device which is the subject of this invention and in which.

DESCRIPTION OF THE PREFERRED EMBODIMENT

Figure 1:
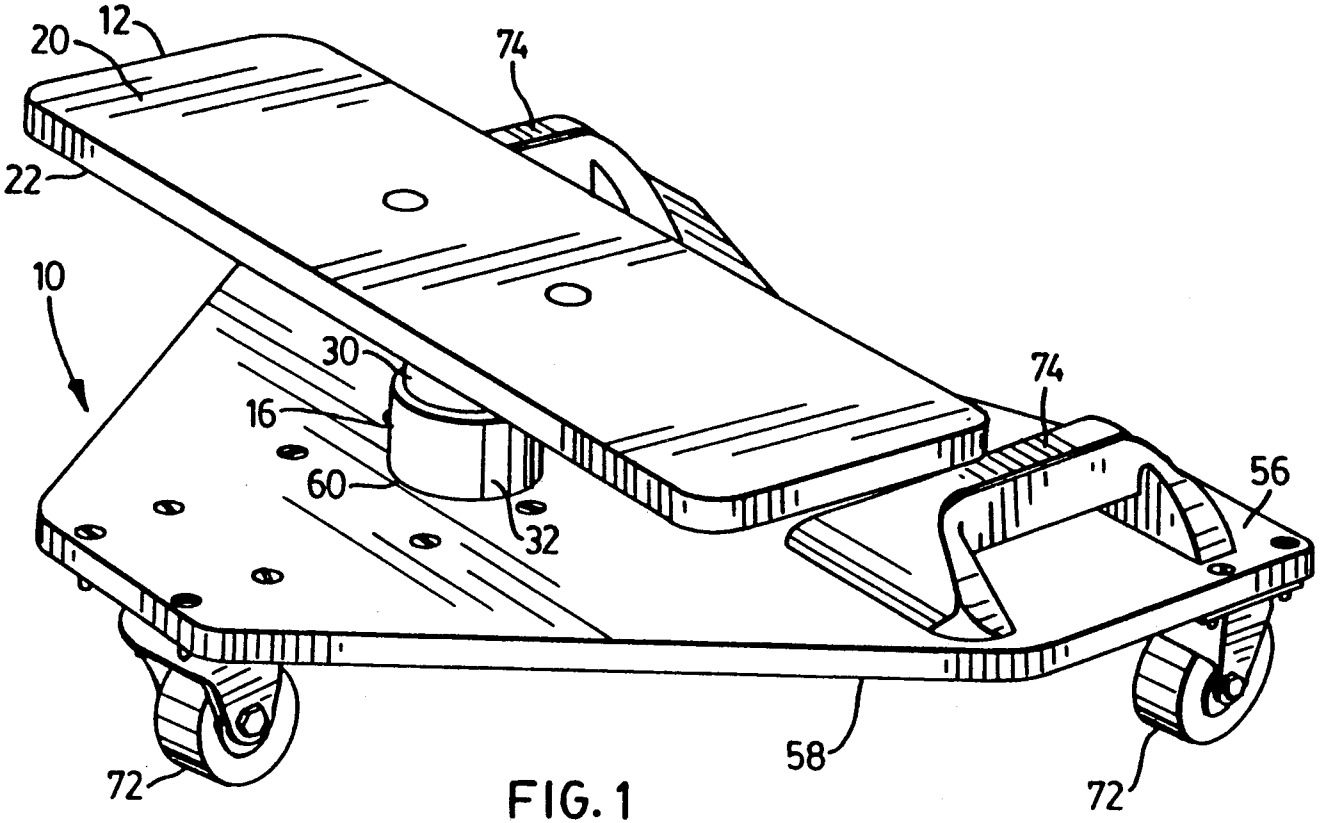
FIG. 1 is a perspective view from above of a gymnastic training device according to the present invention.

As shown in the drawings, the gymnastic training device is generally denoted by reference 10. The gymnastic training device comprises first support means 12 second support means 14 and support member 16.

First support means 12 has an upper side 20 and a lower side 22. First support means 12 is designed so that it may be used by a person in performing a handstand or other gymnastic activity. First support means 12 may be made of any desired material which will provide the requisite strength and may be of any shape which will provide the necessary work area for the user. It thus provides a stable platform upon which the user may balance. As shown in the Figures, first support means 12 comprises a rectangularly-shaped platform.

As shown in FIG. 1, support member 16 is centrally mounted on lower side 22 of first support means 12. As will become apparent later in the discussion, support member 16 is used to secure first support means 12 at a desired position above second support means 14.

Figure 4:
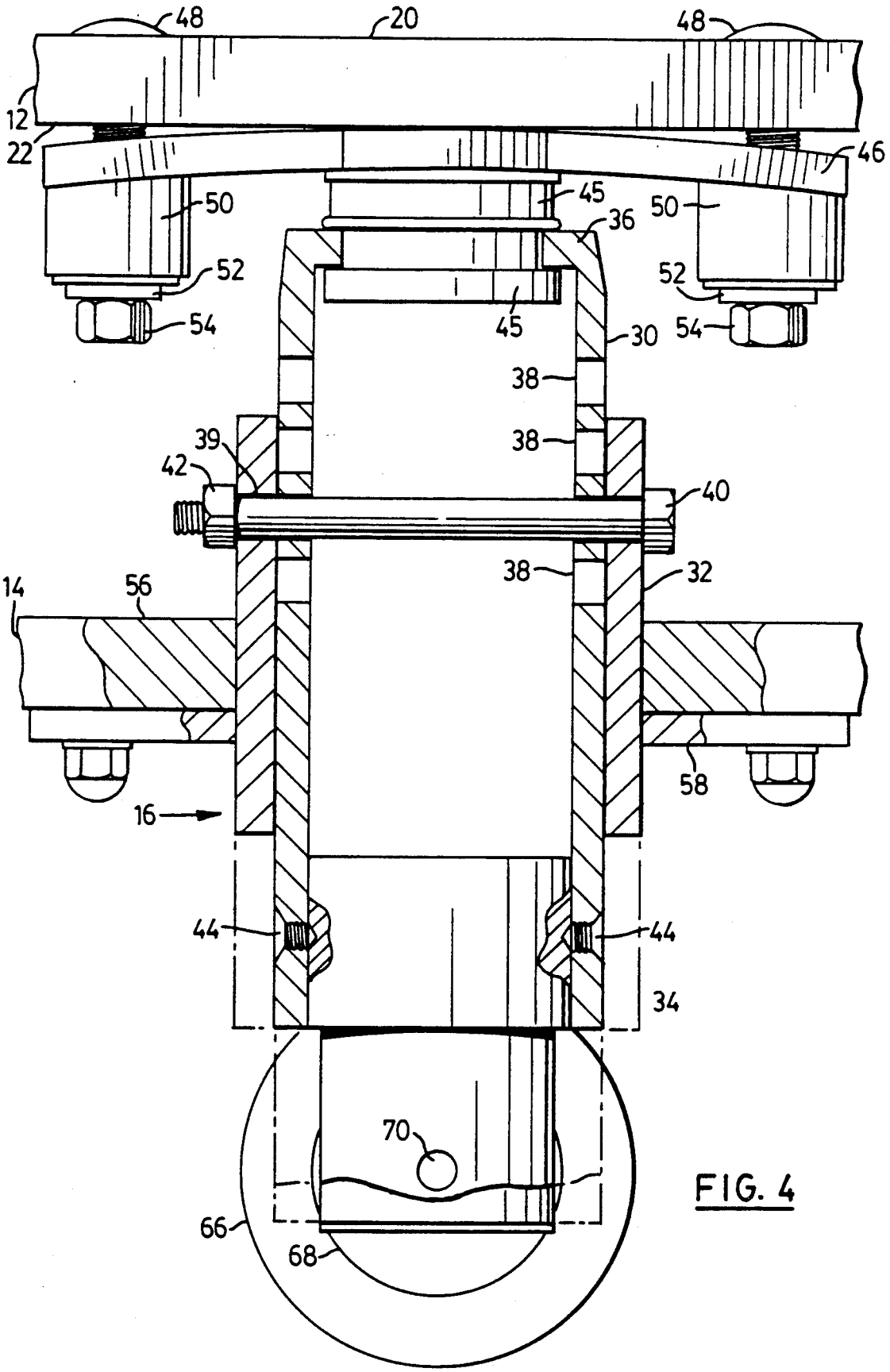
FIG. 4 is a cross-sectional view through the line 4—4 in FIG. 3.

As shown in FIG. 4, support member 16 comprises first tube 30 second tube 32 and third tube 34. First tube 30 comprises a longitudinal cylinder having a cap 36. Located within the vertical walls of first tube 30 are a plurality of pairs of openings 38. Each pair of openings 38 is disposed such that one hole is located half the way around the circumference of first tube 30 from its respective hole such that a line drawn between a pair of holes 38 defines a diameter of first tube 30.

Second tube 32 comprises a cylindrical tube 32. Tubes 30 and 32 are sized such that first tube 30 is concentric located within and is freely displaceable within second tube 32. Second tube 32 has one pair of openings 39. Bolt 40 with nut 42 is provided to secure first tube 30 in position relative to second tube 32 by passing through a pair of holes 38 in first tube 30 which have been aligned with the pair of holes 39 in second tube 32.

Third tube 34 is provided at the lower end of first tube 30. Third tube 34 is sized to be freely displaceable along the longitudinal axis first tube 30. First tube 30 is provided with set screws 44 which, when tightened, will secure third tube 34 in a fixed position relative to first tube 30.

As discussed above, first support means 12 is rotatably mounted on support member 16. Preferably, first support means 12 is mounted so as to permit the first support means to rock from side to side when the gymnastic device is in use. In addition, first support means 12 may be made of a resilient material which will deform slightly under loading conditions. As shown in FIG. 4, in the preferred embodiment bearing 45 is mounted on cap 36 of first tube 30. Cam member 46 is mounted on bearing member 45 below first support means 12. Screws 48 are located adjacent the distal ends of cam member 46. Screw 48 passes through a hole in first support means 12 (not shown) through a hole in cam member 46 (not shown) through compression member 50 and washer 52. Screw 48 is retained in position by means of nut 54.

By this arrangement, both first support means 12 and cam member 46 are rotatable in a generally horizontal plane about support member 16. In addition, cam member 46 provides a surface along which first support means 12 may pivot when a downward force is applied to first support means 12. As first support means 12 pivots downwards, it contacts the distal end of cam member 46. Compression member 50 may be of any general design which will act as a damping means to absorb downward motion applied to the distal ends of cam surface 46 by first support means 12. Compression member 50 may be made of any resilient material such as rubber. If a strong dynamic load is applied to first support means 12, the support means will pivot downwards along cam surface 46 causing compression member 50 to compress. Such compression will absorb the force causing the dynamic loading and act as a shock absorber.

Figure 2:
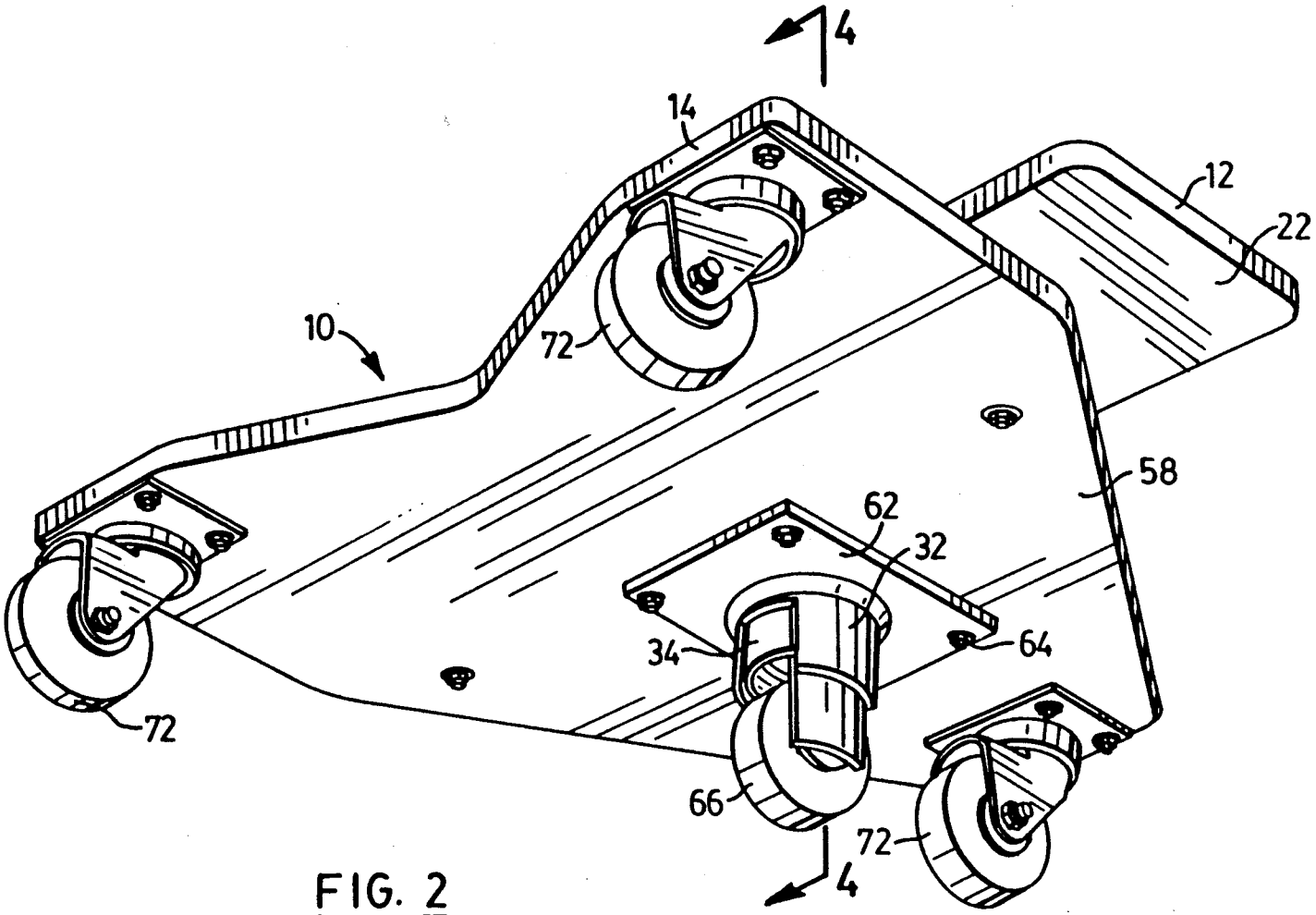
FIG. 2 is a perspective view from below of the device of FIG. 1.

Second support means 14 has an upper surface 56 and a lower surface 58. Second support means 14 may be made of any desired material which will provide the requisite strength and may be of any shape which will provide the necessary work area for the user. As shown in FIG. 1, second support means 14 is generally triangular in shape and has a centrally located opening 60. Support member 16 passes through opening 60 such that second support means 14 is fixed in position below first support means 12. Support member 16 may be fixed to second support means 14 by any means which is conventionally used in the art. As shown in FIG. 2, support member 16 is fixed to lower surface 58 of second support means 14 by means of plate 62 and screws 64.

Ground engaging wheel means 66 is provided at the lower portion of support member 16. Ground engaging wheel means 66 is non-rotatably mounted to support member 16. As shown in FIG. 4, ground engaging wheel means 66 comprises wheel 68 and axle 70.

Figure 3:
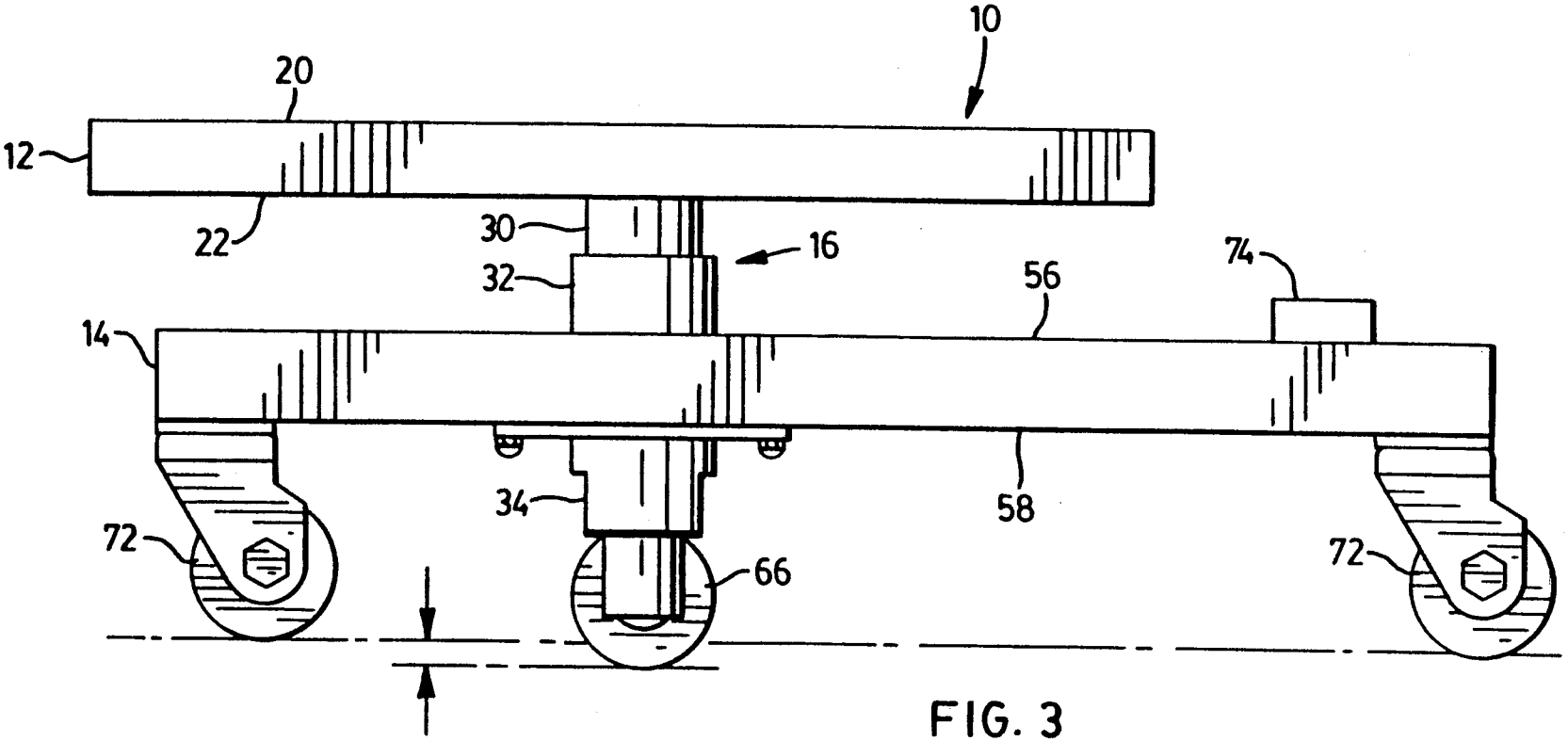
FIG. 3 is a side view of FIG. 1.

Three rotatably mounted wheels 72 are mounted on lower side 58 of second support means 14. Rotatable wheels 72 define a triangle encompassing ground engaging wheel means 66. In addition, as shown in FIG. 3, the lowermost portion of ground engaging wheel 68 is lower than the lowermost portion of each of wheels 72, when the plane defined by the rotatably mounted wheel means is horizontal. While not shown in FIG. 3, in the preferred embodiment, when rotatable wheels 72 are positioned so that they define a substantially horizontal plane, the distance between the lowermost portion of each rotatable wheel 72 and the ground is approximately equal.

As shown in FIG. 1, handles 74 are provided towards the base of generally triangularly shaped second support means 14. Each handle 74 is located at one end of said base. Preferably, handles 74 are located approximately shoulder width apart.

In operation, the user positions himself at the rear of the device, namely the base line defined by handles 74. The user would then take hold of the device by means of handles 74. Depending upon the level of expertise of the user, the user would then be able to raise himself into an upside down position and perform a handstand, headstand or other gymnastic move. The user would try to perform this handstand while balancing the device 10 on ground engaging wheel 68. If the user is slightly off balance, then gymnastic training device 10 will tilt to one side. At this time, at least one of rotatable wheels 72 would contact the ground. In this way, rotatable wheels 72 provide training wheels that limit the rocking motion of the gymnastic training device 10 while the user is developing strength, balance and co-ordination in an upside down position.

In a more advanced level, the user would be able to develop balance while the device was in motion. This arises since the device is mounted on wheels. Prior to performing the handstand, the user, while positioned behind handle 74, could propel the device while raising himself to an upside down position.

At a still more advanced level, the user could place their head in the centre of first support means 12 and their hands at either end of this support means. As first support means 12 is rotatably mounted on support member 16, the user would then be able to develop skill, strength and co-ordination while both maintaining themselves in an upside down position and rotating relative to the ground. Further, due to the use of cam member 46 and compression member 50, first support means 12 would rock to one side or the other if the user does not maintain his centre of gravity in line with support member 16. This trains the user to more accurately maintain their centre of gravity in a uniform position.

As discussed above, support member 16 includes pairs of openings 38 and 39, first and second tube 30 and 32, bolt 40 and nut 42. These members comprise an adjustment means for varying the height of the first support means relative to the second support means. Prior to operation of the device, the user may unscrew nut 42 from bolt 40 and re-align one pair of openings 38 of first tube 30 with the pair of openings 39 in second tube 32. Once the desired height is selected and the hole openings are aligned, bolt 40 is placed through the openings 38 and 29 in first and second tube 30 and 32 and nut 42 is set in place.

In addition, set screws 44 comprise a second adjustment means for varying the height of the second support member relative to the ground. Once again, prior to utilizing the device, the user would loosen set screws 44 and position the ground engaging wheel at the desired distance from second support means 14. Once the desired distance is reached, set screws 44 are tightened and the device is ready for use. As may be readily appreciated; in another embodiment of the invention, two separate support members may be employed; one located between the first and second support means and one mounted on the lower side of second support means 14 between support means 14 and ground engaging wheel means 66.

It will be readily appreciated that to those skilled in the art that various modifications of the device may be made including the members which comprise the adjustment means, the support means, as well as the shape of the first and second support means. All of these modifications are within the scope of this invention.

We claim:

1. A gymnastic balancing training device comprising:

(a) first substantially horizontal support platform defining an upper side and a lower side, said lower side having a central portion;

(b) a substantially vertical support member having first and second ends, said first substantially horizontal support means mounted on one end of said support member within said central portion;

(c) means for permitting rotation of said first substantially horizontal support platform in a substantially horizontal plane about said substantially vertical support member;

(d) ground engaging wheel means mounted to the other end of said substantially vertical support member;

(e) a generally horizontal second substantially horizontal support platform defining an upper side a lower side and a second central portion; and (f) three rotatably mounted wheel means attached to said lower side of said second substantially horizontal support platform, said rotatably mounted wheel means spaced to define a triangle which encompasses said ground engaging wheel means, the lowermost portion of said ground engaging wheel means being lower than the lowermost portion of each of said rotatably mounted wheel means when the plane defined by said rotatably mounted wheel means is horizontal;

said substantially vertical support member and said ground engaging wheel means being adapted to cooperate with said first substantially horizontal support platform to provide a mobile surface for the user to balance upon, said substantially vertical support member being attached to said second substantially horizontal support platform within said central portion at a location on said substantially vertical support member between said ground engaging wheel means and said first substantially horizontal support platform.

2. A device as claimed in claim 1 wherein the vertical distance between the lowermost portion of each of said rotatably mounted wheel means and the ground is approximately equal.

3. A device as claimed in claim 1 wherein said substantially vertical support member has first extension means for adjusting the length of the portion of said substantially vertical support member between said lower side of said substantially horizontal second support platform and said ground engaging wheel means.

4. A device as claimed in claim 3, wherein said support member comprises second extension means for adjusting the length of the portion of said substantially vertical support member between said upper side of said substantially horizontal second support platform and said lower side of said first substantially horizontal support platform.

5. A device as claimed in claim 1 wherein said second substantially horizontal support platform is mounted on said substantially vertical support member at a position within said triangle.

6. A gymnastic training device comprising:

(a) a first substantially horizontal support platform, having an upper side and a lower side, said lower side having a central portion;

(b) a substantially vertical support member having first and second ends, said first substantially horizontal support platform mounted on one end of said substantially vertical support member within said central portion;

(c) means for permitting rotation of said first substantially horizontal support platform in a substantially horizontal plane about said support member;

(d) ground engaging wheel means mounted to the other end of said substantially vertical support member;

(e) a generally horizontal second substantially horizontal support platform defining an upper side and a lower side said second substantially horizontal support platform is fixedly attached to said substantially vertical support member at a location on said substantially vertical support member between said ground engaging wheel means and said first substantially horizontal support platform;

(f) three rotatably mounted wheels attached to said lower side of said second substantially horizontal support platform, said rotatably mounted wheels being spaced to define a triangle which encompasses said ground engaging wheel means the lowermost portion of said ground engaging wheel means being lower than the lowermost portion of each of said rotatably mounted wheels when the plane defined by said rotatably mounted wheels is horizontal, said second substantially horizontal support platform being mounted on said substantially vertical support column at a portion within said triangle.

7. A device as claimed in claim 6 further comprising first extension means for adjusting the length of the portion of said substantially vertical member between said lower side of said second substantially horizontal support platform and said ground engaging wheel.

8. A device as claimed in claim 7 further comprising second extension means for adjusting the length of the portion of said substantially vertical member between said upper side of said second substantially horizontal support platform and said lower side of said first substantially horizontal support platform.

9. A device as claimed in claim 8 further comprising cam means mounted on said support member adjacent said lower side of said first substantially horizontal support platform permitting rotation, up to an angle of about 20° measured from said lower said of said first substantially horizontal support platform towards said substantially vertical support member, of said first substantially horizontal support platform on said substantially vertical support member about a substantially horizontal axis and compression means mounted at the ends of said cam means distal from said substantially vertical support member for defining the maximal point of said rotation.

10. A device as claimed in claim 9 further comprising hand grips mounted on said upper side of said second substantially horizontal support platform.

11. A device as claimed in claim 10, wherein said first substantially horizontal support platform is generally rectangular.

12. A device as claimed in claim 11, wherein said second substantially horizontal support platform is generally triangular in shape and the surface area of said second substantially horizontal support platform is larger than the surface area of said first substantially horizontal support platform.

13. A device as claimed in claims 1 or 12 wherein said first substantially horizontal support means is made of a resilient material.

14. A gymnastic training device comprising:

(a) first substantially horizontal support means, defining an upper side and a lower side, said lower side having a central portion;

(b) A first substantially vertical support member having first and second ends, said first substantially horizontal support means mounted on one end of said first substantially vertical support member within said central portion;

(c) ground engaging wheel means mounted to the other end of said first substantially vertical support member;

(d) three rotatably mounted wheel means mounted on said lower side of said first substantially horizontal support means, said rotatably mounted wheel means being spaced to define a triangle which encompasses said ground engaging wheel means, the lowermost portion of said ground engaging wheel means being lower than the lowermost portion of each of said rotatably mounted wheel means when the plane defined by said rotatably mounted wheel means is horizontal;

(e) a second substantially vertical support member having first and second ends, one end of said second substantially vertical support member is mounted on said upper side of said first substantially horizontal support means;

(f) second substantially horizontal support means defining an upper side and a lower side, said lower side having a second central portion, said lower side of said second substantially horizontal support means is mounted on said other end of said second substantially vertical support member within said second central portion and, (g) means for permitting rotation of said second substantially horizontal support means about said second substantially vertical support member.

15. A device as claimed in claim 14, wherein said second substantially horizontal support means is made of a resilient material.

16. A device as claimed in claim 14, wherein said device includes cam means mounted on said second substantially vertical support member adjacent to said lower side of said second substantially horizontal support means permitting limited rotation of said second substantially horizontal support means on said second substantially vertical support member about a substantially horizontal axis and compression means mounted at the ends of said cam means distal from said substantially vertical support member for defining the maximal point of said limited rotation.

17. A device as claimed in claim 14, wherein said second substantially vertical support member includes mounting means permitting limited rotation about a substantially horizontal axis of said second substantially horizontal support means on said second substantially vertically support member.

18. A device as claimed in claims 17 or 16 wherein said second substantially horizontal support means is rotatable about said substantially horizontal axis up to an angle of about 20° measured from said lower said of said second substantially horizontal support means towards said second substantially vertical support member.

19. A device as claimed in claim 17, wherein said first substantially vertical support member has extension means for adjusting the length of said first substantially vertical support member.

20. A device as claimed in claim 19, wherein said second substantially vertical support member has extension means for adjusting the length of said second substantially vertical support member.

21. A device as claimed in claim 20 wherein said first substantially vertical support member is an extension of said second substantially vertical support member.

22. A device as claimed in claim 21, wherein said device comprises hand grips mounted on said upper side of said first substantially horizontal support means.

23. A device as claimed in claim 22, wherein said second substantially horizontal support means is a generally rectangular shaped platform.

24. A device as claimed in claim 23, wherein said first substantially horizontal support means is a generally triangularly shaped platform and the surface area of said first substantially horizontal support means is larger than the surface area of second substantially horizontal support means.

* * * * *